US006422961B1

(12) United States Patent
Feeney

(10) Patent No.: US 6,422,961 B1
(45) Date of Patent: Jul. 23, 2002

(54) RUBBER BASKETBALL WITH SKIVED CHANNEL LOOK

(75) Inventor: Brian Feeney, Enfield, CT (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

(21) Appl. No.: 09/490,224

(22) Filed: Jan. 24, 2000

Related U.S. Application Data

(60) Provisional application No. 60/117,149, filed on Jan. 25, 1999.

(51) Int. Cl.[7] ..... A63B 41/08
(52) U.S. Cl. ..... 473/604; 473/596
(58) Field of Search ..... 473/596, 597, 473/603, 604, 605, 607, 609

(56) References Cited

U.S. PATENT DOCUMENTS 2,116,479 A * 5/1938 Reach ..... 473/604
2,214,179 A * 9/1940 Reach ..... 473/604
2,317,939 A * 4/1943 Riddell ..... 473/604
3,119,618 A 1/1964 Moliter et al.
4,000,894 A 1/1977 Butzen
4,093,219 A 6/1978 Piraud
4,318,544 A * 3/1982 Brine, Jr. ..... 473/596
4,333,648 A 6/1982 Aoyama
4,462,590 A 7/1984 Mitchell
4,570,931 A * 2/1986 Martin ..... 473/596
5,181,717 A 1/1993 Donntag et al.
5,306,001 A * 4/1994 Shishido et al. ..... 473/604
5,310,178 A 5/1994 Walker et al.
5,413,331 A 5/1995 Stillinger
5,636,835 A 6/1997 Schlinder et al.
5,669,838 A 9/1997 Kennedy et al.
5,681,233 A * 10/1997 Guenther et al. ..... 473/605

* cited by examiner

*Primary Examiner*—Steven Wong

(57) ABSTRACT

A basketball formed with a molded cover having tactile indicia for determining the orientation and position of the molded panel areas of the basketball. The indicia associated with the panel areas include wide depressed areas formed in the cover material of the molded rubber basketball and extending longitudinally with channels formed within the basketball cover.

7 Claims, 2 Drawing Sheets

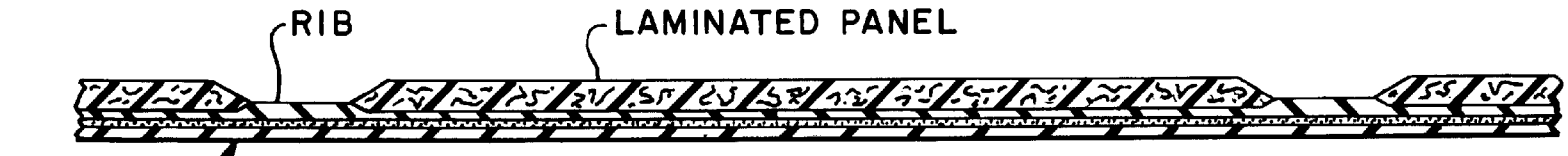
FIG. 1 – CONVENTIONAL LAMINATED BASKETBALL
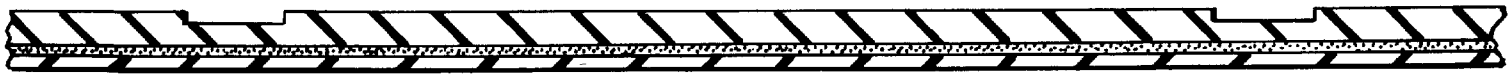
FIG. 2 – CONVENTIONAL MOLDED BASKETBALL
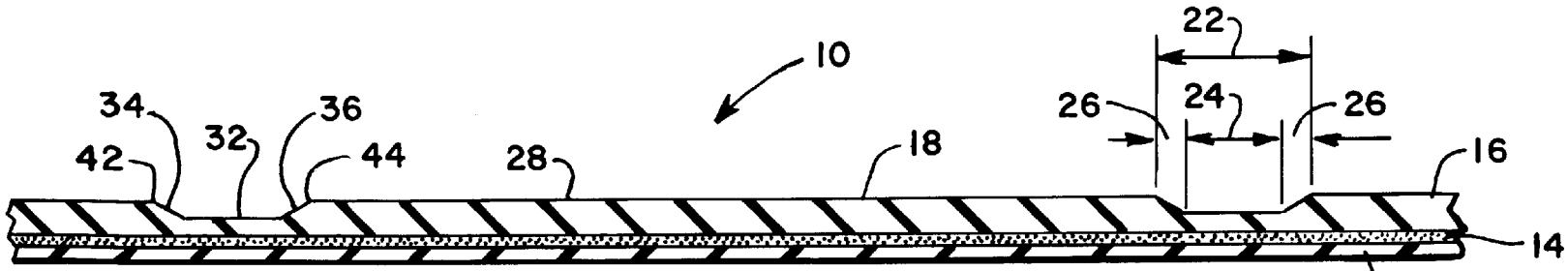
FIG. 3

RUBBER BASKETBALL WITH SKIVED CHANNEL LOOK

CROSS REFERENCE TO RELATED APPLICATIONS

This application claims the benefit of U.S. Provisional Application No. 60/117,149, filed Jan. 25, 1999.

FIELD OF THE INVENTION

The present invention relates generally to basketballs and more particularly to basketballs with covers formed from molded rubber.

BACKGROUND OF THE INVENTION

Laminated basketballs typically comprise an interior bladder, an intermediate layer of monofilament strands wrapped around the bladder, a carcass comprised of a pair of elastomeric hemispheres molded over the winding layer with exteriorly extending ribs defining panel areas therebetween and panels of leather secured within the spaces by an adhesive. The panels have "skived" or beveled edges so that the panel edge is even with the projecting carcass rib to create a seam area. While these laminated basketballs exhibit desirable characteristics in handling and play, the complicated construction leads to increased cost for this type of ball.

A large number of basketballs manufactured for playground and less demanding general play use feature molded rubber construction. These basketballs typically have a multi-layer structure which includes an air bladder wrapped with windings and an outer cover comprised of rubber molded over the windings. Molded rubber balls possess good wear and durability characteristics for the rough use received in indoor and outdoor play at a lower cost than laminated balls.

The covers of molded rubber balls are formed with various features which tend to simulate somewhat the overall appearance of a basketball of traditional construction. One of the features incorporated into basketballs with molded rubber covers is the simulation of the eight panels and carcass ribs of a traditional laminated basketball. The simulated panels of the molded basketball are divided by shallow, narrow, square notch shaped grooves which represent the laminated areas of a laminated construction basketball. This cover configuration for a molded rubber ball has gained wide acceptance and is now typical.

In addition to aesthetics, the seam areas of a laminated basketball also serve a functional purpose. One aspect of ball control is the ability to readily impart a desired amount of backspin to the ball when it is passed or when a basket is attempted. Imparting backspin is considered to be of high importance in helping direct a ball into the basket which first makes contact with the backboard or rear portion of the hoop of the basketball goal. In this instance, backspin is converted into downward motion of the ball upon contact with the backboard, thereby urging the ball into the goal. In handling the ball in preparation for passing the ball to another player or shooting the ball in an attempt to score a basket, the high skill level player preferably aligns the seam areas of the laminated basketball perpendicular to the intended line of flight of the ball. With the seam areas aligned in this manner, the player is able to place their fingers and/or thumbs on the seam areas to obtain greater leverage for imparting backspin and therefore, superior control of the ball. With conventional molded rubber basketballs the shallowness and narrow width of the square notch grooves allows less leverage and control of the ball.

In the course of play it is preferable for the person handling the ball to locate the seam areas using tactile input alone. With conventional molded rubber balls, the shallowness and narrow width of the square notch grooves makes them difficult to locate by touch. Of course, the player can look directly at the ball to determine orientation of the grooves, however visual observation of the ball is a serious distraction during game play.

SUMMARY OF THE INVENTION

An object of the present invention is to provide a basketball having a molded rubber cover including tactile indicia associated with the grooves formed in the cover of the ball.

Another object of the present invention is to provide a molded rubber basketball which is easier for players to handle and control.

Other objects will be in part obvious and in part pointed out more in detail hereinafter.

These and related objects are achieved by providing a basketball of molded construction comprising an air bladder which is wrapped with a monofilament strand for retaining the shape and size of the ball when inflated. A cover of elastomeric material is formed or molded over the wrapped bladder. The cover of the molded rubber ball features molded "panel" areas which simulate the general appearance of the laminated panels of a traditional leather covered ball. The panel areas are defined and bounded by seam areas comprising channels and associated, coextensive depressed areas formed in the molded cover. The channels and depressed areas have a pre-determined shape, depth and width. The channels are disposed so that they are generally centered along the longitudinal axis of a pair of depressed areas.

Each seam area is of sufficient depth and width to provide for improved tactile indicia of its location and orientation. In addition, the seam areas provide an enlarged contact surface for the player's fingers and thumbs to act against for imparting backspin when shooting or passing the ball. The invention accordingly comprises the several steps and/or features and relation of one or more of such steps and/or features with respect to the others and the article in possession of the features, properties, and relationship of elements as exemplified in the following detailed disclosure.

BRIEF DESCRIPTION OF THE DRAWINGS

FIG. 1 is a sectional view of a portion of a basketball with a conventional laminated cover;

FIG. 2 is a sectional view of a portion of a basketball with conventional molded cover;

FIG. 3 is a sectional view of a portion of one embodiment of an inventive molded cover basketball;

DETAILED DESCRIPTION OF THE INVENTION

Figure 4:
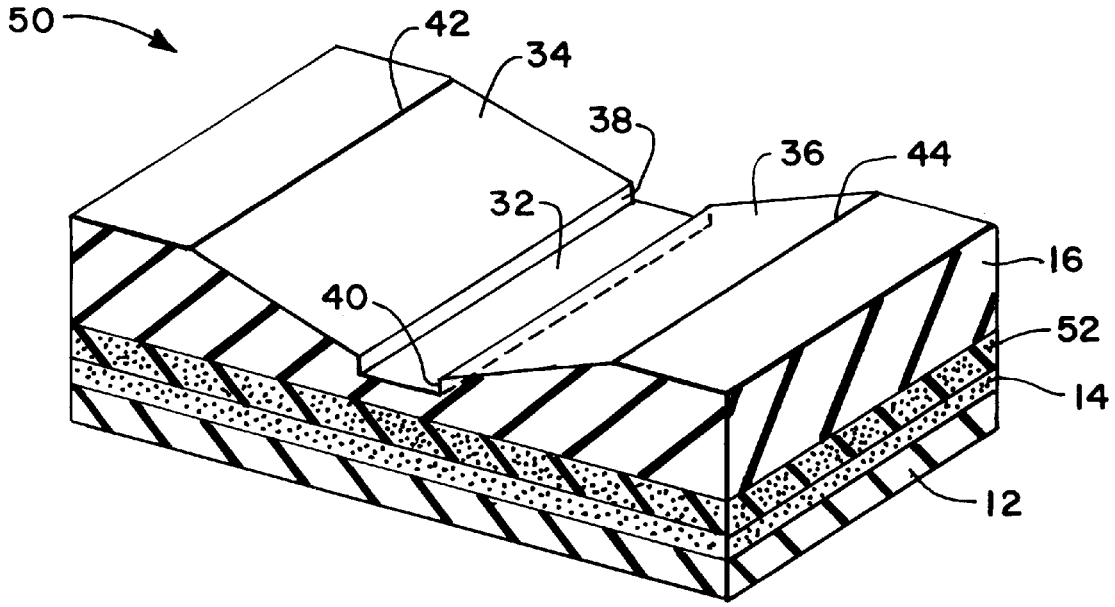
FIG. 4 is a perspective and sectional view of a portion of a second embodiment of the inventive molded cover basketball.

With reference to the drawings, wherein like numerals represent like parts, an inventive molded cover basketball is generally designated by the numeral 10. In FIG. 3, a section of a molded rubber basketball of the present invention is shown. The ball includes an air bladder 12 which forms an envelope within which the air used to inflate the basketball 10 is retained. The air bladder 12 for use in the present invention is of the type conventionally used in the manufacture of molded rubber basketballs. Such air bladders are usually formed of butyl rubber or butyl and natural rubber compounds and are fitted with a valve (not shown)for introducing air into the ball to inflate and pressurize the structure.

Wound over the air bladder 12 is a layer 14 of monofilament polymer strands which help the ball 10 retain its spherical shape and size while under the stresses of inflation and play. The monofilament windings applied to the bladder are of the type conventionally used in the manufacture of a basketball. The windings typically are made of polyester or nylon and may be coated with an adhesive such as a solution of latex rubber for bonding to the air bladder.

Disposed over the winding layer 14 is a layer 16 of cover material which forms the exterior surface of the ball. Typically, the cover material is a natural or synthetic rubber which is molded into a single piece cover layer 16, thereby incorporating the winding layer and air bladder into a unitary structure of the ball.

The exterior surface 18 of the cover 16 typically has a molded-in pebble texture (which for clarity is not shown). The molded-in pebble texture simulates the texture of pebble grain leather and provides for improved grip and handling of the ball. Also, molded into the surface 18 are a plurality of seam areas 22 comprising shallow, shaped channels 24 and associated depressed areas 26. The seam areas 22 correspond in their relative locations on the ball 10 to the locations of seam areas on a traditional laminated basketball. It will be appreciated that the seam areas 22 formed in a molded rubber ball 10 establish the outline of the simulated panel areas 28 which are molded into the cover 16 of the inventive molded rubber basketball 10. The cover 16 of the inventive basketball would have a thickness in the panel areas 28 in the range of 0.8 to 2.5 mm, with 1.0 to 2.2 mm being preferred, and 1.8 to 2.0 mm being most preferred.

The exact shape of the seam area 22 may be varied, according to practical and aesthetic considerations. The simplest seam area shape as shown in FIG. 3 is a channel 24 which, when viewed in transverse cross-section, has only a flat channel floor 32. A shaped or inclined depressed area wall 34,36 on each side of the channel floor 32 joins the channel floor to the adjacent panel area 28. Each wall 34,36 descends from the exterior surface 18 of the cover at the panel area 28 down to a lower elevation intersecting the channel floor 32. A depressed area wall 34,36 may also intersect a channel wall 38,40 vertically rising from the channel floor 32 as shown in FIG. 4. At the transition between the wall 34,36 and the exterior surface 18 of the ball there is a shoulder 42,44. The shoulder 42,44 can be formed so that a simple angular transition is made from the cover surface 18 to the wall 34,36. Alternatively, the shoulder can be radiused or otherwise shaped to obtain a smooth, or even a flowing transition from the cover exterior surface 18 to the wall 34,36. The opposing shoulders 42,44 define the width of the seam area 22. Preferably, the walls 34,36 are positioned and shaped to be symmetric on each side of the longitudinal centerline of the channel 24 with which it is associated. The walls 34,36 define the depressed areas 26 associated with the channel 24.

It will be appreciated that although the seam area 22 shown in FIG. 3 is formed generally of segments of straight lines, other configurations are possible and are fully comprehended by this invention. For example, the floor of the channel may be curved, thereby forming a channel having a rounded "U" shape bottom when viewed in cross-section. The walls 34,36 may have a contour which is essentially flat, wherein the slope of the wail from the shoulder 42,44 to the channel floor 32 is constant as shown in FIG. 3. Alternatively, the wall may have a curved contour wherein the slope of the wall varies from the shoulder to the channel. The choice of wall contour is believed to be more related to production or aesthetic considerations and less important to the performance of the finished ball. The overall effect of the inventive molded seam area 22 is to give the molded rubber basketball the appearance and handling characteristics of a more expensive laminated ball having a rib between adjacent skived panel areas.

The channel 24 typically has a width within the range 3 to 7.5 mm. The width of each wall 34,36 is typically in the range of 3 to 8 mm, with a range of 4 to 6 mm being preferred. Thus, the width of the entire seam area 22 of the present invention is typically within the range of about 10 to 24 mm, with a range of 12 to 22 mm being preferred, and a range of 14 to 18 mm being most preferred. This compares to typical laminated basketballs which typically have a seam area width of 2.5 to 6.4 mm, and molded basketballs which typically have no inclined depressed area walls and a square notch width of 3 to 7.5 mm.

Figure 5:
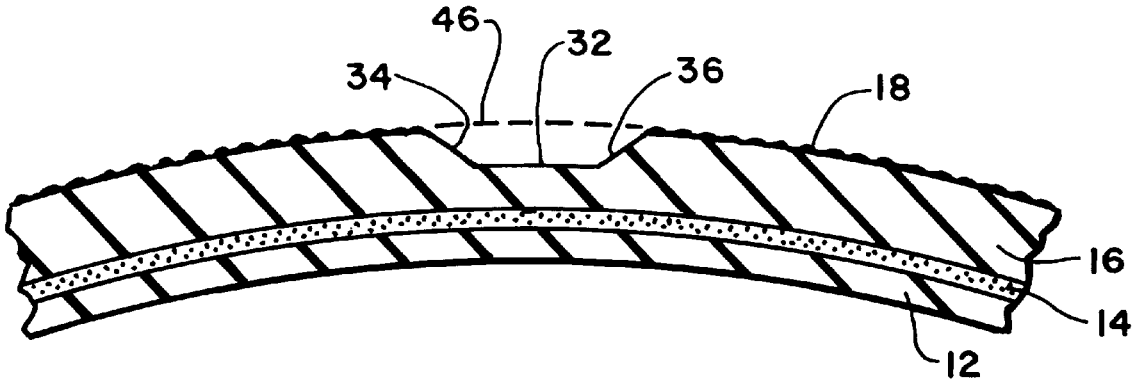
FIG. 5 is a sectional view of a portion of an inventive molded cover basketball.

The depth of the channel 24 is the distance from the channel floor 32 to a circumference 46 defined by the exterior surface 18 of the ball 10. It will be appreciated that the exterior surface and the circumference of the ball takes into account the irregular pebble-grain finish which is typically molded into the cover of the ball as shown in FIG. 5. Taking a channel depth measurement is accomplished by use of a depth gauge which is fitted with an arcuate saddle that approximates the circumference 46 of the ball. The arcuate saddle engages the exterior surface 18 of the ball, whether defined by a pebbled surface or a smooth surface, and allows the feeler of the gauge to project downward to the channel floor 32 from the circumference 46 defined by the outer surface of the ball. The use of an arcuate saddle prevents the gage from being positioned below the circumference of the ball and thus taking the measurement from a point below the circumference. The depth of the inventive channel is within the range of 0.8 to 2.5 mm, with 1.0 to 2.0 mm being preferred, and 1.2 to 1.8 mm being most preferred. Channel depths greater than 2.5 mm can cause basketball to bounce in unexpected and uncontrolled fashion. Typical laminated basketballs have a considerably shallower seam depth, ranging from 0.6 to 1.4 mm while typical molded basketballs have a square notch groove depth of 0.1 to 0.6 mm. The thickness of the cover 16 in the area of the channel floor 32 will be in the range of 0.4 to 1.2 mm, with a range of 0.5 to 0.8 mm being preferred.

FIG. 4 illustrates another embodiment of the present invention, wherein an inventive basketball 50 includes an air bladder 12, layer 14 of monofilament strands wound around the bladder, and a cover 16 molded over the wrapped bladder and defining a plurality of depressed areas 26 and simulated skived panels 28 as previously described in reference to FIG. 3. Further, the embodiment of FIG. 4 features a discrete layer 52 of foamed rubber in addition to the cover layer 16 of molded rubber. The layer of foamed rubber 52 is typically disposed between the winding layer 14 and the cover layer 16. The foamed layer 52 between the winding layer 14 and cover 1.6 allows the finished basketball 50 to have a softer feel which tends to improve grip of the ball and playability while still allowing a solid cover for abrasion resistance. When properly inflated, a basketball 10 with a non-foamed molded cover will have a Shore A hardness of 65 or higher while a basketball 50 incorporating a foamed layer 52 as previously described will have a Shore A hardness of 20 to 60. It would also be possible to foam a portion of the cover layer without the use of a discrete foamed layer and achieve similar finished basketball hardnesses.

The foamed layer 52 may be produced by adding a blowing agent to the rubber material comprising the foamed layer in an amount sufficient to create a foamed rubber of the desired density. Typically, the foamed layer 52 has a density in the range of 0.5 to 0.9 g/cm$^3$. The foamed layer 52 has a typical thickness in a range of 0.5 to 2.0 mm, with 0.7 to 1.5 mm being preferred. In a ball 50 having a foamed layer 52 underlying the cover 16, the unfoamed cover 16 has a thickness in the panel areas 28 in the range of 0.3 to 1.2 mm, with 0.6 to 1.0 mm being preferred. The thickness of the cover 16 in the area of the channel floor 32 will be in the range of 0.6 to 1.8 mm, with a range of 0.8 to 1.4 mm being preferred.

The ball of the present invention may be produced largely in a conventional manner. Accordingly, the air bladder 12 of the ball would be inflated to an appropriate size and preferably cooled to cause the material of the bladder to become somewhat rigid. In this rigid condition, the air bladder 12 is wound with an adhesive coated monofilament strand. The foamed layer 52, if present, is typically formed around the substructure formed by the air bladder 12 and the wound monofilament strand layer 14 in a molding process, wherein the substructure is placed in a mold and the foamed layer 52 molded around the substructure.

The rubber material comprising the exterior cover layer is placed within a split mold. The material of the exterior cover layer 16 typically is in the form of two hemispheres with each hemisphere placed in one of the molds. The wound air bladder is placed within one of the hemispheres, and the mold is closed. Heat and pressure are applied to the hemispheres which causes the outer cover material to flow into and around the strands of the wound layer for a secure mechanical bond and to vulcanize the outer cover material. The inner surfaces of the mold are tooled so that the molding process further creates the desired exterior surface texture, as well as the inventive panel areas 28 and seam areas 22, including channels 24 and associated depressed areas 26. If a basketball incorporating a foamed layer 52 between the wound layer 14 and cover layer 16 is desired, a subunit comprising the air bladder 12, layer of windings 14 and foamed layer 52 may be substituted in place of the wound air bladder.

Subsequently, the completed ball is taken from the mold and flash from the molding process is trimmed from the ball. The ball is then in condition for the application of decals, paint or other decorative or informative markings.

As will be apparent to persons skilled in the art, various modifications and adaptations of the structure described above will become readily apparent without departure of the spirit and scope of this invention.

What is claimed is:

1. A basketball of molded construction, comprising:

an inflatable bladder;

a monofilament strand wound around said bladder to define a winding layer; and a seamless cover molded over said winding layer, said cover comprising an interior surface, a plurality of simulated panel areas defining an exterior surface, a plurality of simulated seam areas separating adjacent said molded panel areas, each simulated seam area comprising a floor with parallel edges disposed between said interior and exterior surfaces and obliquely angled walls connecting one said edge to one said panel area.

2. The basketball of claim 1 wherein said exterior surface defines a circumference and a distance defined between said circumference and said floor is within the range of 1.2 to 1.8 millimeters.

3. The basketball of claim 1 wherein a said seam area defines a width within the range of 10 to 24 millimeters.

4. The basketball of claim 1 wherein a said seam area defines a width within the range of 14 to 18 millimeters.

5. The basketball of claim 1 wherein a said wall defines a width within the range of 3 to 8 millimeters.

6. The basketball of claim 1 wherein a said wall defines a width within the range of 4 to 6 millimeters.

7. The basketball of claim 1 comprising a foamed layer intermediate said winding layer and said cover, said foamed layer having inner and outer surfaces defining a thickness within the range of 0.5 to 2.0 millimeters and said cover interior and exterior surfaces defining a thickness within the range of 0.3 to 1.2 millimeters in said panel areas.

* * * * *